US008340315B2

(12) United States Patent
Kantola

(10) Patent No.: US 8,340,315 B2
(45) Date of Patent: Dec. 25, 2012

(54) ASSEMBLY, SYSTEM AND METHOD FOR ACOUSTIC TRANSDUCERS

(75) Inventor: Martin Kantola, Karperö (FI)

(73) Assignee: Oy Martin Kantola Consulting Ltd, Karpero (FI)

( * ) Notice: Subject to any disclaimer, the term of this patent is extended or adjusted under 35 U.S.C. 154(b) by 1291 days.

(21) Appl. No.: 11/915,677

(22) PCT Filed: May 26, 2006

(86) PCT No.: PCT/FI2006/050215
§ 371 (c)(1),
(2), (4) Date: Nov. 27, 2007

(87) PCT Pub. No.: WO2006/125869

PCT Pub. Date: Nov. 30, 2006

(65) Prior Publication Data

US 2008/0199023 A1 Aug. 21, 2008

(30) Foreign Application Priority Data

May 27, 2005 (FI) ..... 20055261

(51) Int. Cl.
*H04R 3/00* (2006.01)
*H04R 5/00* (2006.01)

(52) U.S. Cl. ..... 381/92; 381/21

(58) Field of Classification Search ..... 381/21, 381/26, 91–92; 257/254, 416, E21.324
See application file for complete search history.

(56) References Cited

U.S. PATENT DOCUMENTS 3,720,787 A 3/1973 Ishii et al.
4,042,779 A * 8/1977 Craven et al. ..... 381/103
4,072,821 A 2/1978 Bauer
4,096,353 A * 6/1978 Bauer ..... 381/21
(Continued)

FOREIGN PATENT DOCUMENTS

JP 5191886 A 7/1993
(Continued)

OTHER PUBLICATIONS

Malham, Dave, "Using ordinary microphones to emulate a Soundfield", Available in internet: http://www.york.ac.uk/inst/mustech/3daudio/sndfield.html Oct. 15, 2001, York University Music Technology Group.

(Continued)

*Primary Examiner* — Calvin Lee
(74) *Attorney, Agent, or Firm* — Sughrue Mion, PLLC

(57) ABSTRACT

The invention relates to an assembly of acoustic transducers, a system and a method for receiving and reproducing sound. The assembly comprises a first acoustic transducer having a directional pattern of the shape of a figure of eight in the direction of an X axis of a XYZ coordinate system, and a second acoustic transducer placed perpendicularly relative to a first capsule and providing a directional pattern of the shape of a figure of eight in the direction of a Y axis of a XYZ coordinate system. The assembly is characterized in that it further comprises a third acoustic transducer placed perpendicularly relative to the first and second acoustic transducers, enabling the implementation of spatial sound both in a XY plane and in a XYZ plane by using these acoustic transducers placed in accordance with an axis of the axes of the XYZ coordinate system. The invention further provides a system and a method for processing signals received with the assembly.

10 Claims, 16 Drawing Sheets

U.S. PATENT DOCUMENTS

| | | | | |
|---|---|---|---|---|
| 4,329,547 | A | 5/1982 | Imai | |
| 4,757,545 | A | 7/1988 | Rosander | |
| 6,108,270 | A | 8/2000 | DePoy, II | |
| 7,787,638 | B2 * | 8/2010 | Lokki et al. | 381/92 |
| 2001/0016020 | A1 | 8/2001 | Gustafsson et al. | |
| 2008/0219485 | A1 * | 9/2008 | Kantola | 381/303 |

FOREIGN PATENT DOCUMENTS

| | | | |
|---|---|---|---|
| JP | 9233589 | A | 9/1997 |
| WO | 2004077884 | A1 | 9/2004 |
| WO | 2005055644 | A1 | 6/2005 |

OTHER PUBLICATIONS

Torio, G. and Segota J., "Unique Directional Properties of Dual-Diaphragm Microphones" AES Convention 109, Aug. 2000, Available in internet:URL:http://www.aes.org/sections/chicago/AES_LA_6_21_00.PDF, pp. 1-28, Shure Incorporated, Evanston, Illinois.

Earle, J., "The Microphone Book", second edition, Focal Press, New York, pp. 84-86.

* cited by examiner

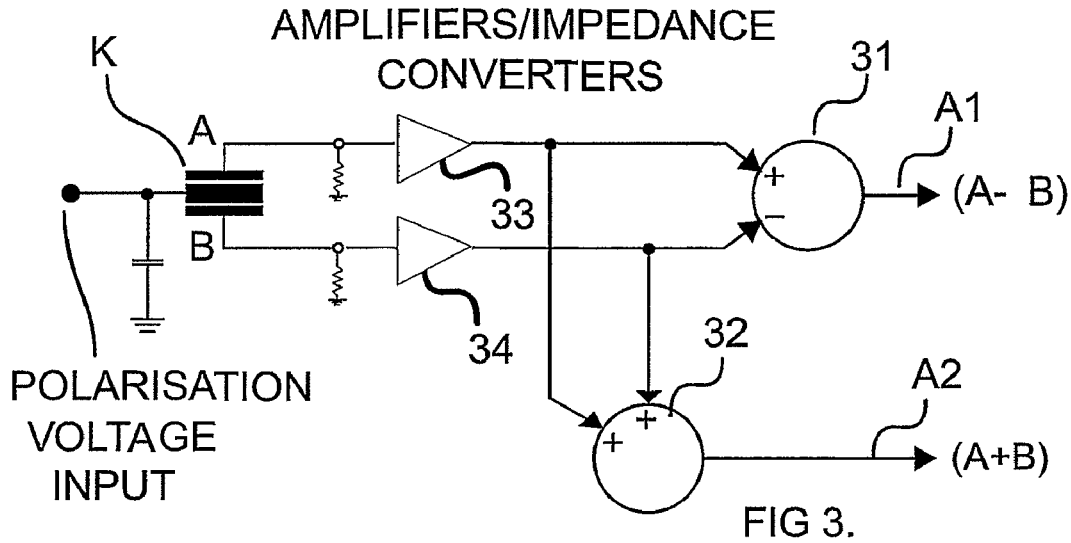
FIG 3.
FIG 4A.
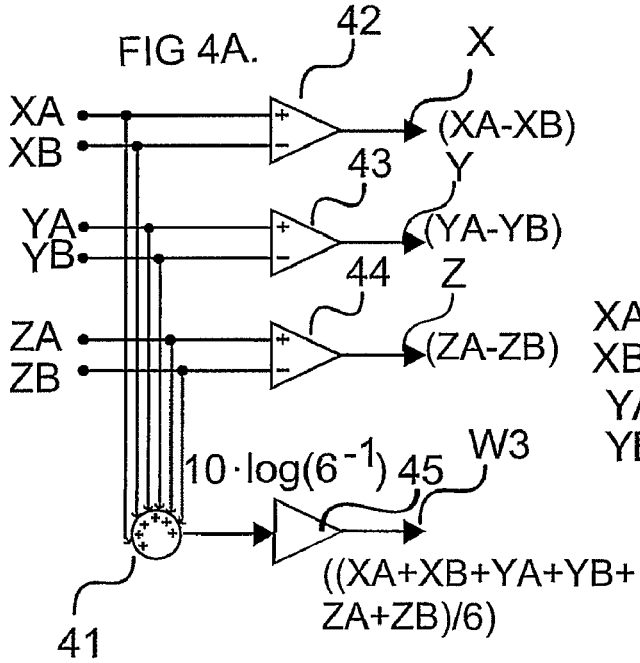
FIG 4B.
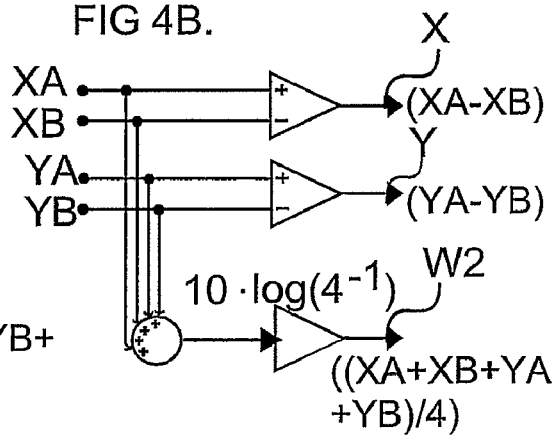
FIG 4C.
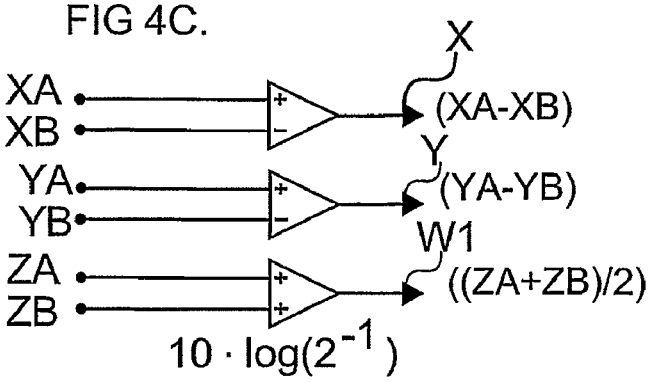

(YA - YB)

(XA - XB)

(XA + XB + YA + YB + ZA + ZB)/6

$$((XA-XB) \cdot \cos(45)) + ((YA-YB) \cdot \sin(45)) + ((XA + XB + YA + YB)/4)$$

$$((XA-XB) \cdot \cos(270)) + ((YA-YB) \cdot \sin(270)) + ((XA + XB + YA + YB)/4)$$

ASSEMBLY, SYSTEM AND METHOD FOR ACOUSTIC TRANSDUCERS

BACKGROUND OF THE INVENTION

The invention relates to the technique of recording and re-producing spatial sound. As home theatres are becoming more common, a large portion of consumers has a home theatre. The aim of home theatres is to reproduce credible spatial sound, such as in a recording situation. At present, the equipment is most generally of type 5.1, including two front loudspeakers, a central loudspeaker, two back loudspeakers and one subwoofer controlled by the LFE channel for low-frequency sound effects. Other such Surround systems include the 7.1, 8.1 and 10.2 systems, for example, part of which are designed only for theatre use, not for an ordinary consumer. However, such 5.1 equipment requires six channels and does not include elevation information. In such systems, the loudspeakers are to be placed at the designed locations around the listener.

However, it is practically impossible to reproduce sound according to the original recording situation, and consequently, techniques have to be employed for producing a sound world that sounds as authentic as possible. For example, in reproduction with earphones, attempts have been made to model the behaviour of the ear with HRTF (Head Related Transfer Function). However, a signal modified with HRTF has conventionally been an artificially panned mono source.

In the 1970's, a technique called Ambisonics, which was designed as a recording technique for spatial sound, was developed for recording and reproducing spatial sound. However, in recording sound, the Ambisonics technique is expensive. In recording, a Soundfield microphone has to be employed that tends to receive the entire 360° sound field by means of four adjacent cardioid capsules placed in the form of a tetrahedron. Patent publication EP 0869967 B1 discloses a microphone intended for recording spatial sound. Therein, the microphones have an omni-directional pattern. In this case, the microphones have to be placed on the surface of a hard ball. Between the several microphones placed on the surface of the ball is a distance of the length of the diameter of the ball. This distance causes harmful time differences.

BRIEF DESCRIPTION OF THE INVENTION

The object of the invention is thus to provide a simple-structured assembly of acoustic transducers and a method of receiving and reproducing acoustic signals. The assembly of acoustic transducers and the method intended for receiving and reproducing an oriented direction and 2D or 3D spatial sound is implemented in a manner enabling the implementation of high-quality reception or reproduction of spatial sound in spite of the simple structure. The object of the invention is achieved with an assembly and a method that are characterized in what is stated in the independent claims. Preferred embodiments are described in the dependent claims.

An aspect of the invention is to provide an assembly of acoustic transducers and a method enabling the reception of signals of different directions in the XY plane with two or three dual-diaphragm acoustic transducers as three audio signals. Out of the three audio signals generated by the assembly and corresponding to authentic 2D spatial sound, different n-direction signals can be separated, wherein n is 8, for example. For transfer or reproduction, the method can also be implemented inversely, whereby the corresponding signals, in this case the signals of eight different directions, can be transformed into three signals. The assembly of three acoustic transducers according to one aspect of the invention enables the reception of signals also in the XYZ plane. In the XYZ plane, the Z plane corresponds to elevation information, whereas X and Y correspond to audio signal information in the horizontal plane.

A second aspect of the invention is to provide an assembly of acoustic transducers enabling the reproduction of signals of different directions in the XY plane with two or alternatively three acoustic transducers. Another alternative assembly of acoustic transducers enables the reproduction of signals also in the XYZ plane. In accordance with one aspect of the invention, the elevation plane (Z plane) signals can be reproduced with two different elements.

In an additional aspect of the invention, an assembly of acoustic transducers is provided, wherein a filtering part is added to two transducers of the assembly. One purpose of this filtering part is to provide acoustic correction for the capsules of the acoustic transducer. Another purpose is to attempt to prevent signals from hitting the surface of more than one acoustic transducer. A third purpose is to reduce the attenuation of high frequencies from predetermined directions of about 45 degrees and 90 degrees, for example.

Still another aspect of the invention is to provide an assembly for an arrangement and a method enabling the simultaneous provision of both an omni and a figure-of-eight pattern from one acoustic transducer comprising a dual diaphragm. For transfer and reproduction, the method is also implementable inversely. Consequently, an aspect of the invention is to provide an assembly for an arrangement and a method enabling the reception and reproduction of a combination of the different directional pattern halves of an omni and figure-of-eight directional pattern with one acoustic transducer.

Still another aspect of the invention is to provide an arrangement and a method for generating signals X, Y and signal W, having an omni pattern, for planar 2D spatial sound from signals received by an assembly of dual-diaphragm acoustic transducers.

Still another aspect of the invention is to provide an arrangement and a method for generating signals X, Y and signal W for 3D spatial sound from signals received by an assembly of three dual-diaphragm acoustic transducers.

Still another aspect of the invention is to provide an arrangement and a method for reproducing spatial sound from signals X, Y and signal W intended for planar spatial sound, observed in the X, Y plane.

Still another aspect of the invention is to provide an assembly for an arrangement and a method for reproducing 3D spatial sound from signals X, Y, Z and W, intended for spatial sound.

Still another additional aspect of the invention is to provide a supplementary device associated with the arrangement and method for reproduction according to the assembly of the invention, wherein movements of the listener's head are taken into account when a signal is transmitted for reproduction from the headphones.

Still another additional aspect of the invention is to provide a supplementary device associated with the assembly according to the invention for following the signals received with the assembly of acoustic transducers in such a manner that the device orients itself towards the signal source and follows the signal source in accordance with predetermined selection grounds.

Still another additional aspect of the invention is to provide a supplementary device associated with the assembly according to the invention for narrowing the directional patterns of the signals received with the assembly of acoustic transducers for separating a given part for orientation.

In accordance with an aspect of the present invention, two acoustic transducers having a figure of eight directional pattern, such as microphones, are provided perpendicularly relative to each other, enabling the reception of signals from different directions in the XY plane as three audio signals. The third signal is obtained by generating one W signal having an omni pattern from the received signals having a figure-of-eight directional pattern. Signals of several, e.g. eight, directions, can be separated from the three audio signals generated by the assembly. In accordance with one aspect of the invention, this operation can be implemented also inversely, whereby the corresponding eight signals of different directions can be transformed into three signals.

In accordance with another aspect of the present invention, three acoustic transducers having a figure of eight directional pattern, such as a microphone or a hydrophone, are provided perpendicularly relative to each other, enabling the reception of signals of different directions in the XY plane as three audio signals X, Y, W or in the XYZ plane, as four signals X, Y, Z and W. In the XYZ plane, the Z plane corresponds to elevation information, whereas X and Y correspond to audio signal information in the horizontal plane.

Furthermore, in accordance with an aspect of the present invention, an assembly of acoustic transducers is provided, enabling the reproduction of signals of different directions in the XY plane with two or alternatively three acoustic transducers, such as loudspeakers. In accordance with another aspect, the assembly of acoustic transducers also enables the reproduction of the signals in the XYZ plane. In this case, in accordance with an aspect, signals of the elevation plane (Z plane) can be reproduced with two different elements.

One additional aspect of the invention is to provide an assembly of acoustic transducers, wherein a filtration part is added to two transducers of the assembly. The purpose of this filtering part is to provide acoustic correction for the capsule of the acoustic transducer in the Z plane. The aim is to use this filtering part to prevent the attenuation of high frequencies from directions of about 45 degrees and 90 degrees. The filtering part is advantageous if the intention is to employ one of the capsules for creating an omni-patterned signal.

Still another aspect of the invention is to provide an arrangement and a method for simultaneously generating both omni and figure-of-eight patterns from one dual-diaphragm acoustic transducer. For transfer or reproduction, the method is also implementable inversely. Thus, one aspect of the invention is to provide an arrangement and a method for reproducing a combination of the directional pattern halves of an omni and a figure-of-eight directional pattern with one acoustic transducer.

Still another aspect of the invention is to provide an arrangement and a method for generating signals X, Y and omni-signal W for planar spatial sound from signals received with dual-diaphragm acoustic transducers.

Still another aspect of the invention is to provide an arrangement and a method for generating signals X, Y, Z and omni-signal W for spatial sound from signals received with three dual-diaphragm acoustic transducers.

Still another aspect of the invention is to provide an arrangement and a method for reproducing spatial sound from signals X, Y and omni-signal W for planar spatial sound, observed in the XY plane.

Still another aspect of the invention is to provide an arrangement and a method for reproducing spatial sound from signals X, Y, Z and omni-signal W for planar spatial sound.

Still another additional aspect of the invention is to provide a supplementary device associated with the arrangement and the method according to the invention for reproduction, with which movements of the listener's head are taken into account when a signal is being transmitted for reproduction.

Still another additional aspect of the invention is to provide a supplementary device associated with the signal of the arrangement and the method according to the invention for narrowing the directional patterns of a received signal to improve resolving power.

The desired sound material can be generated afterwards from a recording generated with the assembly of the invention for instance by monomixing, stereomixing, 5.1 mixing or other mixing, with which a selected number of signals can be included steplessly, since the assembly of acoustic transducer receives and transfers all acoustic signals from all directions for reproduction. An embodiment according to an aspect of the invention provides an acoustic transducer implementing the method, such as a microphone for receiving sound, enabling signals coming from different directions to be stored for reproducing spatial sound. An acoustic transducer may also be a loud-speaker for reproducing sound. The microphone or loudspeaker according to the invention comprises an acoustic transducer portion and an audio signal-processing portion.

The audio signal-processing unit comprises a separation/combination part, which may comprise combination and/or separation means. The units of an acoustic transducer, such as microphone capsules, are placed in the immediate vicinity of each other, and thus sound arrives at all capsules as simultaneously as possible. Such placement of microphones, a so-called one-point arrangement, enables transfer of accurate direction information. Utilization of such one-point technique enables signals to be subjected to summing and subtraction.

Still another object of the invention is to provide a microphone in a conference room, for example, as such a microphone utilizes the method of the invention and the equipment implementing the method in such a manner that the signals of the different directions are separated in accordance with the method. Signals received from different directions can be separated, compared and attenuated, if need be, allowing a conference microphone to separate/emphasize the sound source/speaker of one direction at a time, and thus the receiving party to the negotiation finds it easier to identify speech and the speaker.

Still another object of the invention is to provide an acoustic transducer, such as a loudspeaker, enabling the provision of spatial sound by employing three transducer units. Spatial sound is provided by combining the signals in accordance with the method of the present invention.

Still another aspect of the invention is to provide an acoustic transducer, such as headphones, for reproducing real spatial sound provided with the assembly of the invention. Spatial sound is provided by combining signals in accordance with the method according to the present invention to loudspeakers in the headphones. The headphones may be provided with a device for observing the movements of the listener's head. A supplementary device enables the provision of binaural recordings in real time such that the head movements are fed into a signal processor, which calculates the changes caused in the movement at the HRFT (Head Related Transfer Function).

The placement of microphones according to an aspect of the invention enables the provision of a microphone for instance in a conference room, whereby the microphone utilizes the method of the invention and the equipment implementing the method such that signals of different directions are separated in accordance with the invention. In this case, signals received from different directions can be separated, compared and attenuated, if need be, allowing a conference microphone to separate/emphasize the sound source/speaker of one direction at a time, and thus the party receiving the conference finds it easier to identify speech and the speaker. The microphones may be dual-diaphragm microphone capsules, known per se, whose small capsular structure allows the arrangement to be made compact. A new kind of capsule arrangement enables similar reproduction from all directions. The reproduction of the microphones may be corrected electrically or acoustically. The coupling arrangement of the invention enables the simultaneous use of dual-diaphragm microphone elements as a figure of eight containing a directional pattern having two directional pattern halves and circular, this enabling determination of the exact position of the sound source according to the invention.

An embodiment of the invention provides an acoustic transducer employed in an underwater acoustic field and having a simple structure, a hydrophone. The hydrophone may comprise a diaphragm employed according to the magnetostatic, electrostatic or piezo principle. The assembly according to the embodiment of the invention is suitable both as a transmitter and as a receiver, a depth sounder, for example.

In accordance with an embodiment of an aspect of the invention, there is provided an acoustic transducer, such as a loudspeaker, for providing spatial sound with three units. Signals are combined into the loudspeaker in accordance with the present method. This allows five or eight loudspeakers to be replaced with three loudspeaker units. In this case, the loudspeakers may be normal conical elements or planar dipole loudspeakers, for example. The loudspeaker radiates at the back backwards in the same manner as forward, but in an opposed phase. In this case, audio signals in the XY plane are reflected to the listener via walls. To emphasize the elevation direction, signals in the Z elevation plane can be repeated with two different elements. The loudspeaker elements may also be dual-diaphragm, in which case pressure shall be conducted from between the diaphragms into a separate space, an enclosure, for example. Said microphone assembly is capable of generating four signals, which may be combined by previously known (MS, Blumlein and Ambisonics) methods at different ratios and polarities. The signals generated with the arrangement and method enabled by the assembly are compatible with said formats, and particularly with the Ambisonics B format.

Accordingly, the assembly of acoustic transducers accomplishes a compact microphone. As few as two small figure-of-eight capsules achieve an 8.1 surround microphone, for example. The new assembly of acoustic transducers is advantageous and easy to manufacture, since the structure of one capsule is known. The utilization of the structure in a new manner enables an acoustically well operating surround microphone, since the time and transfer function differences of the capsules are minimal. A 2D or 3D Surround microphone has good dynamics, since the diaphragms of the capsules may be sufficiently large without compromising said advantage. For its operation, the new kind of arrangement does not require frequency, phase or other electrical compensations and thus sound quality remains as authentic as possible.

BRIEF DESCRIPTION OF THE FIGURES

In the following, the invention will be described in more detail in connection with preferred embodiments with reference to the accompanying drawings, in which

FIG. 3 shows a coupling diagram for achieving an omni pattern and a figure-of-eight pattern from a capsule having one dual diaphragm;

FIG. 4A shows a coupling diagram of an embodiment for achieving four signals from a capsule having three dual diaphragms;

FIG. 4B shows a coupling diagram of an embodiment for achieving three signals from two capsules having two dual diaphragms;

FIG. 4C shows a coupling diagram of an embodiment for achieving three signals from three capsules having a dual diaphragm;

DETAILED DESCRIPTION OF THE INVENTION

Figure 1A:
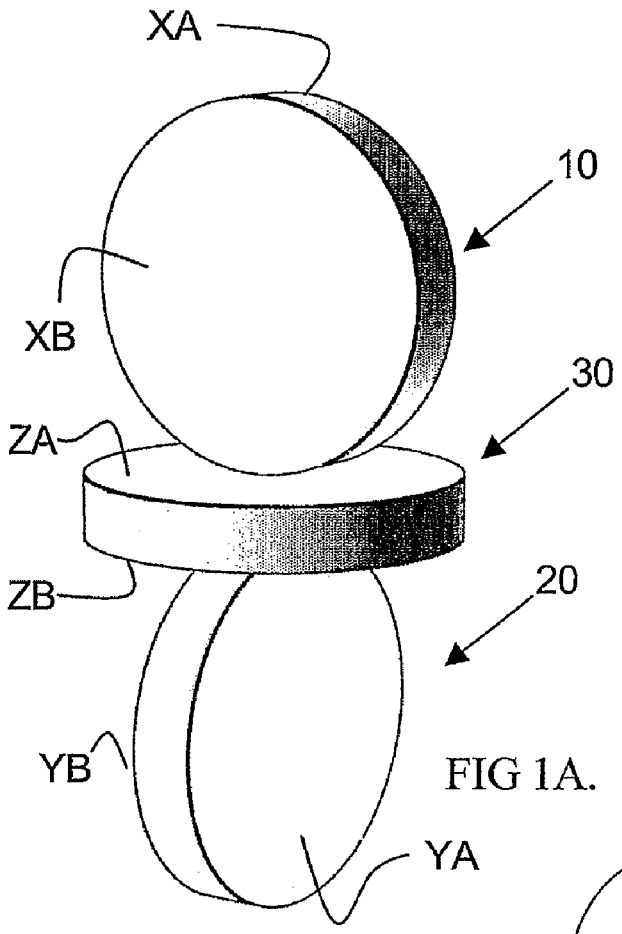
FIG. 1A shows an embodiment of the structure and placement of acoustic transducers.

FIG. 1A shows an embodiment of the structure and placement of an assembly of acoustic transducers. The assembly comprises three superimposed acoustic transducers 10, 20, 30 for receiving and reproducing acoustic signals, the first acoustic transducer 10 having a figure-of-eight directional pattern in the horizontal forward/backward direction (herein, in the direction of the X coordinate axis) and including directional pattern halves XA, XB. The second acoustic transducer 20 has a figure-of-eight directional pattern in the horizontal direction right-left (in the direction of the Y coordinate axis), including directional pattern halves YA, YB. The third acoustic transducer 30 has an upward/downward directional pattern in the direction of the Z coordinate axis, having a circular form when observed in the XY plane and including directional pattern halves (ZA, ZB). In the assembly, the centre points are as close to each other as possible and yet they cover as little of each other as possible. The angles between the acoustic transducers are 90 degrees. Preferably, the acoustic transducers 10, 20, 30 may be dual-diaphragm microphone capsules, in which case the directional pattern halves XA, XB, YA, YB, ZA and ZB are provided with separate diaphragms. The assembly of the invention for receiving acoustic signals may also be used for implementing a hydrophone. In signal reproduction, the acoustic transducers may be loudspeaker elements.

Figure 1B:
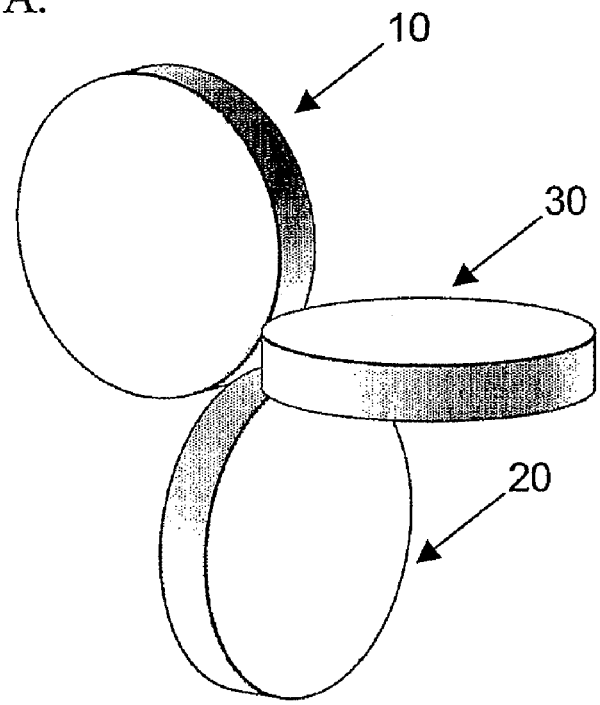
FIG. 1B shows another embodiment of the structure and placement of acoustic transducers.

FIG. 1B shows another embodiment of the structure and placement of an assembly of acoustic transducers 10, 20, 30. In this case, the acoustic transducers are placed adjacently in such a manner that the surface of the periphery of each transducer is in the immediate vicinity of the outer surface of the other two capsules. This assembly allows the distance between the axes of revolution of the acoustic transducers, such as microphones or loudspeakers, to be made small and, simultaneously, the distances between them are equal.

In the previous embodiments, three acoustic transducer units are assembled adjacently in such a manner that, in the case of a microphone, sound arrives at all units as simultaneously as possible and, in the case of a loudspeaker, sound is transferred away from the unit as simultaneously as possible. In the utilization of such one-point technique, signals can be submitted to summing and subtraction.

Figure 2A:
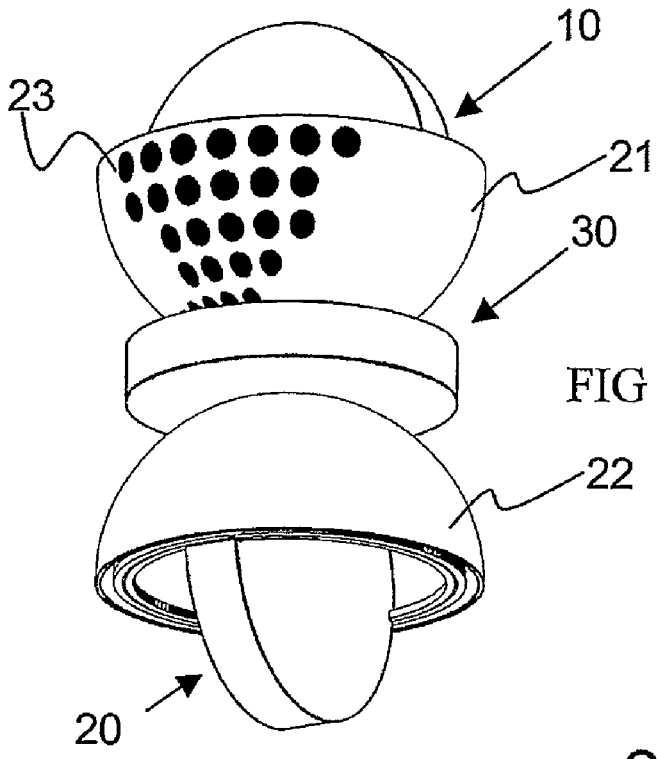
FIG. 2A shows an embodiment wherein additional elements for filtering are arranged in the acoustic transducers of FIG. 1A.
Figure 2B:
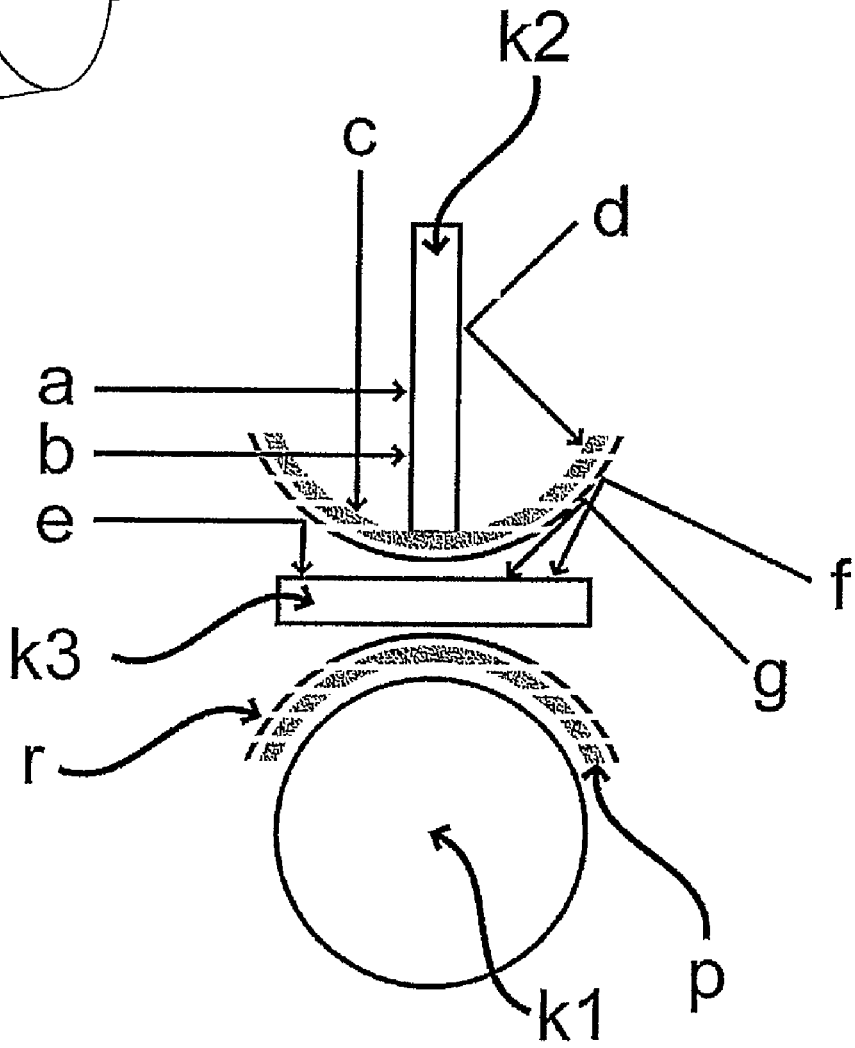
FIG. 2B shows a sectional view of the principle of the filtering of the additional elements of the acoustic transducers shown in FIG. 2A.

FIGS. 2A and 2B show an embodiment wherein filtering parts 21, 22 for filtering are arranged in the acoustic transducers of FIG. 1A. In the figure, the filtering parts are arranged in the uppermost and lowermost acoustic transducer. The filtering parts 21, 22 have a curved shape, which settles at least partly on top of the acoustic transducer. Herein, the filtering parts 21, 22 have a hemispherical shape, but its elevation and curvature may be changed for achieving the desired filtering or attenuation characteristics. The outer surface r of the curved filtering part is arranged to reflect signals to the acoustic transducer in the middle, and its inner surface is arranged to attenuate the reflections of signals hitting it. The attenuating material p may be a material that transforms acoustic energy into thermal energy. The wall of the filtering part 21, 22 is provided with signal-permeable openings 23, which are depicted in the upper acoustic transducer of FIG. 2A. The purpose of the filtering part is to improve the hits of the signals into the correct acoustic transducer, the transducers being placed as closely as possible in accordance with the invention.

FIG. 2B shows a partial sectional view, showing the operating principle of the filtering parts of the acoustic transducers shown in FIG. 2A. Signals e, f and g are reflected into capsule k3 of the middle acoustic transducer. Signal a hits the uppermost capsule k2. Signal b hits capsule k2 through the opening 23 shown in FIG. 2A. Signal d, arriving obliquely from above, is reflected from capsule k2 and then hits the attenuating material p of the filtering part 21. The attenuating material p and the reflecting outer surface r are denoted in the filtering part 22 of capsule k1.

FIG. 3 shows a coupling diagram for simultaneously achieving an omni pattern and a figure-of-eight pattern from one microphone capsule of an acoustic transducer having a dual diaphragm. Polarization voltage input is generated at capsule k with an external power source. Capsule k has two diaphragms A and B, whose signals are separately fed into separate amplifiers (Amplifiers/impedance converters) (33, 34). The signals are then summed with combining means 31, with which a first signal A-B is obtained. Any electrical, external interference in this signal having a figure-of-eight directional pattern are cancelled out in connection with the subtraction. The coupling of FIG. 3 enables the simultaneous summing of signals with a second combining means 32, in order to obtain a second signal A+B, which has an omni directional pattern. In the summing of signals A, B, the interferences in the signals are also summed up, but, on the other hand, this interference is reduced if the omni signals of a plurality of microphone capsules are summed up. In 2D and 3D embodiments, the signals of 1 to 3 capsules maybe used for generating an omni signal. With this arrangement, 2D spatial sound is achieved with two only two capsules. For 3D spatial sound, a third microphone capsule providing elevation information is required.

FIG. 4A shows a coupling diagram of an embodiment for achieving four signals from three capsules having a dual diaphragm. From the signals provided by the three capsules, all signal differences are taken and amplified with amplifiers 42, 43 and 44 into signals X, Y and Z. A sum is taken from all signals with summing means 41, and the sum is then scaled with an amplifier 45 to correspond to the other outputs. Herein, signal W3 obtained with the summing means 41 is an optimal signal having an omni pattern, since it takes a signal from all capsules and all directions. The amplifiers 42, 43, 44 should be balanced. Signal W3 can be alternatively also calculated only by summing up and scaling the signals of only one capsule or two capsules, e.g. XA+XB+ZA+ZB.

FIG. 4B shows a coupling diagram of a 2D embodiment for achieving three signals X, Y and W2 from two capsules having a dual diaphragm. The vertical direction is omitted from this embodiment. Such a 2D embodiment is usable for instance in video cameras or other corresponding devices for recording spatial sound.

FIG. 4C shows a coupling diagram of an embodiment for achieving three signals X, Y and W1 from three capsules having a dual diaphragm. Herein, the elevation-direction capsule exists, but it is only employed in providing an omni-pattern signal. In the example, only signals ZA and ZB are summed up, but in addition, one or both of signal pairs XA, XB and YA, YB could equally well be summed up.

Figure 5:
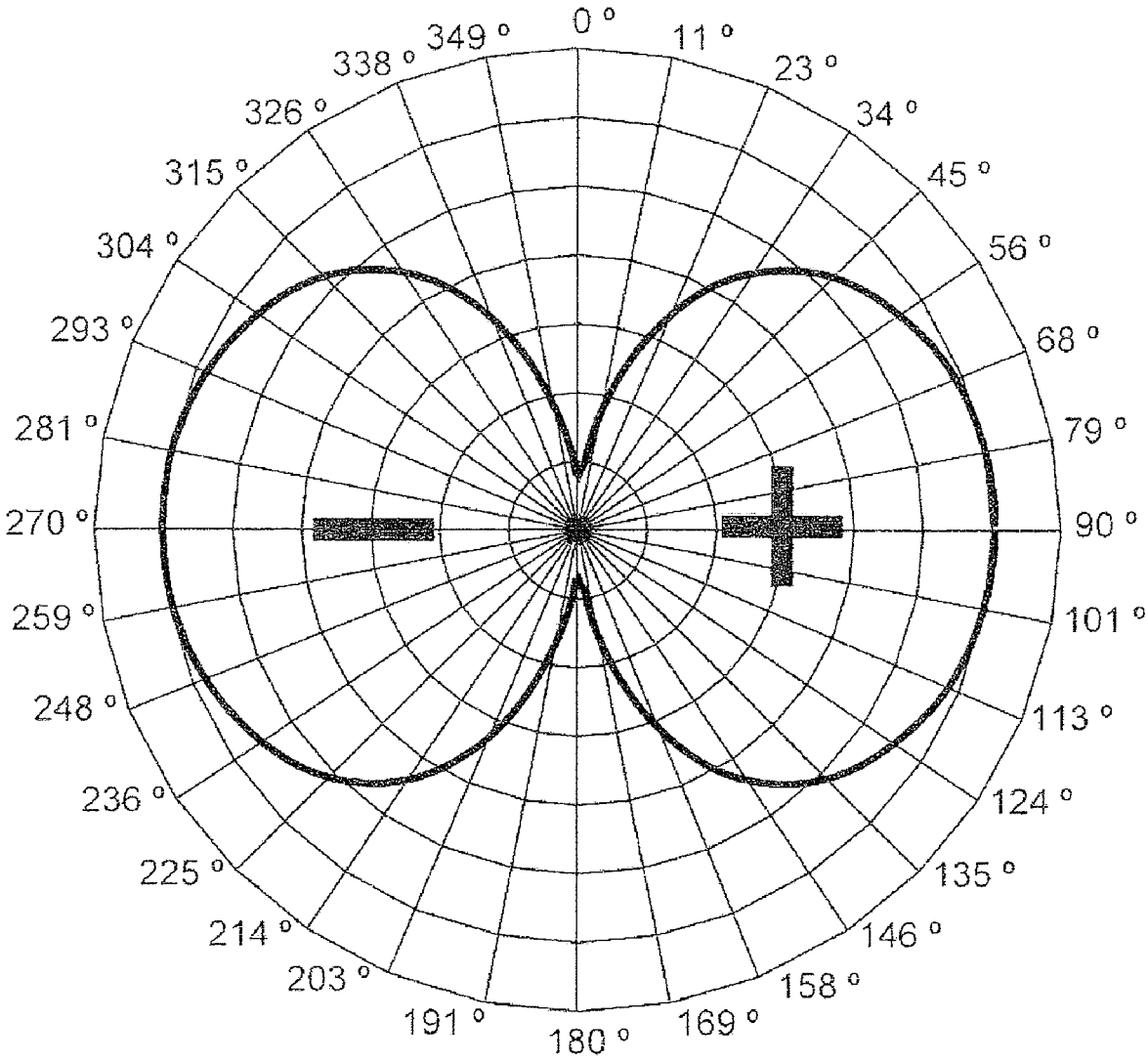
FIG. 5 shows the directional pattern of a Y unit in a direction to the left-right.

FIG. 5 shows the directional pattern of unit Y in the left-right direction. In the directional pattern, the positive directional pattern half YA is on the right and the negative directional pattern half YB is on the left.

Figure 6:
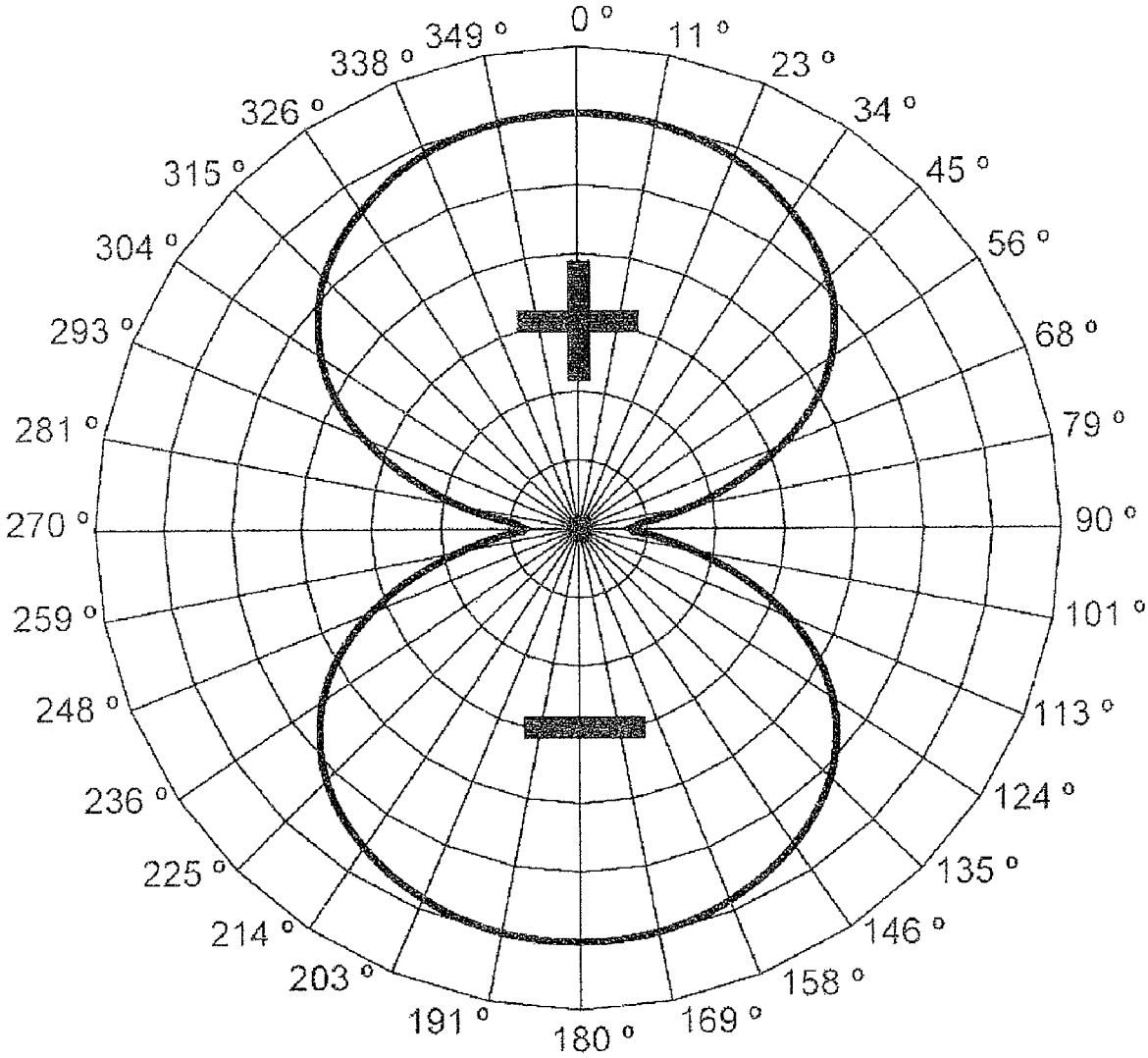
FIG. 6 shows the directional pattern of an X unit in a direction forward-backward.

FIG. 6 shows a directional pattern of unit X in the backward/forward direction. In the directional pattern, the positive directional pattern half XA is on top and the negative directional pattern half XB is underneath.

Figure 7:
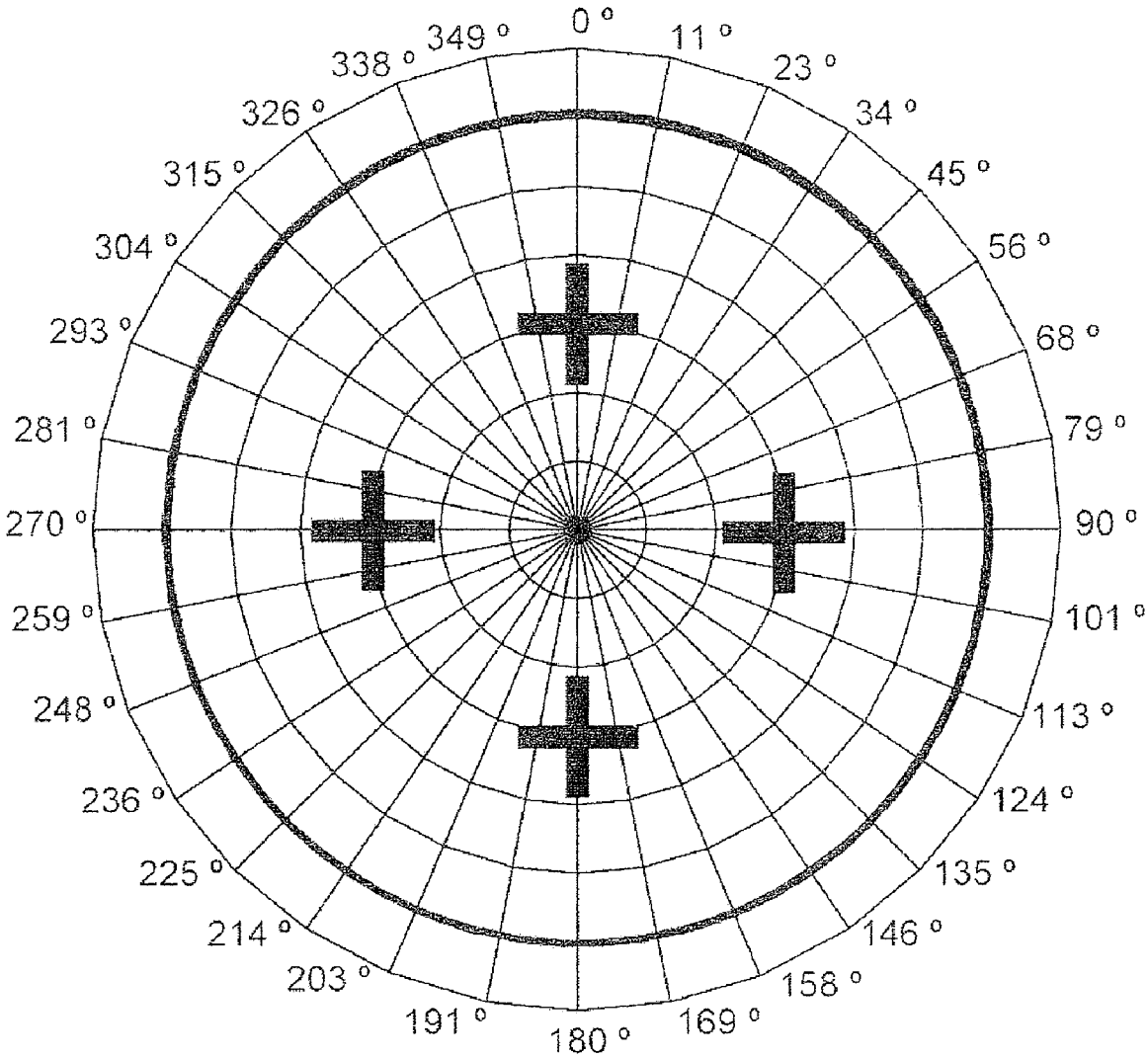
FIG. 7 shows an omni-patterned directional pattern calculated in accordance with the coupling of the embodiment of FIG. 4A.

FIG. 7 shows the directional pattern of an omni signal, calculated in accordance with the coupling of the embodiment according to FIG. 4A, wherein the signals of three acoustic transducers are summed up.

Figure 8:
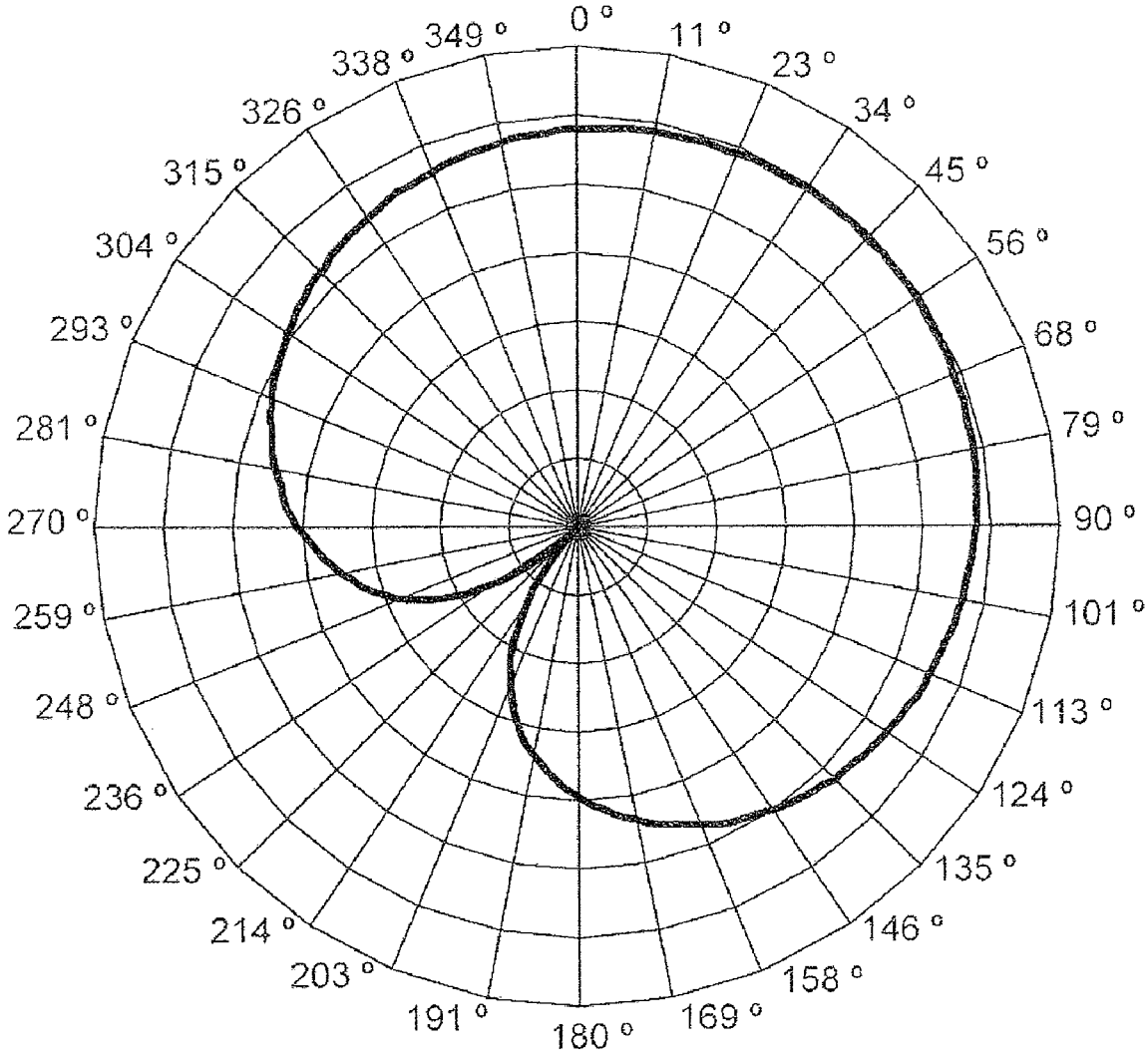
FIG. 8 shows the directional pattern of a signal calculated in accordance with the coupling of the embodiment of FIG. 4B in a 45-degree direction.
Figure 9:
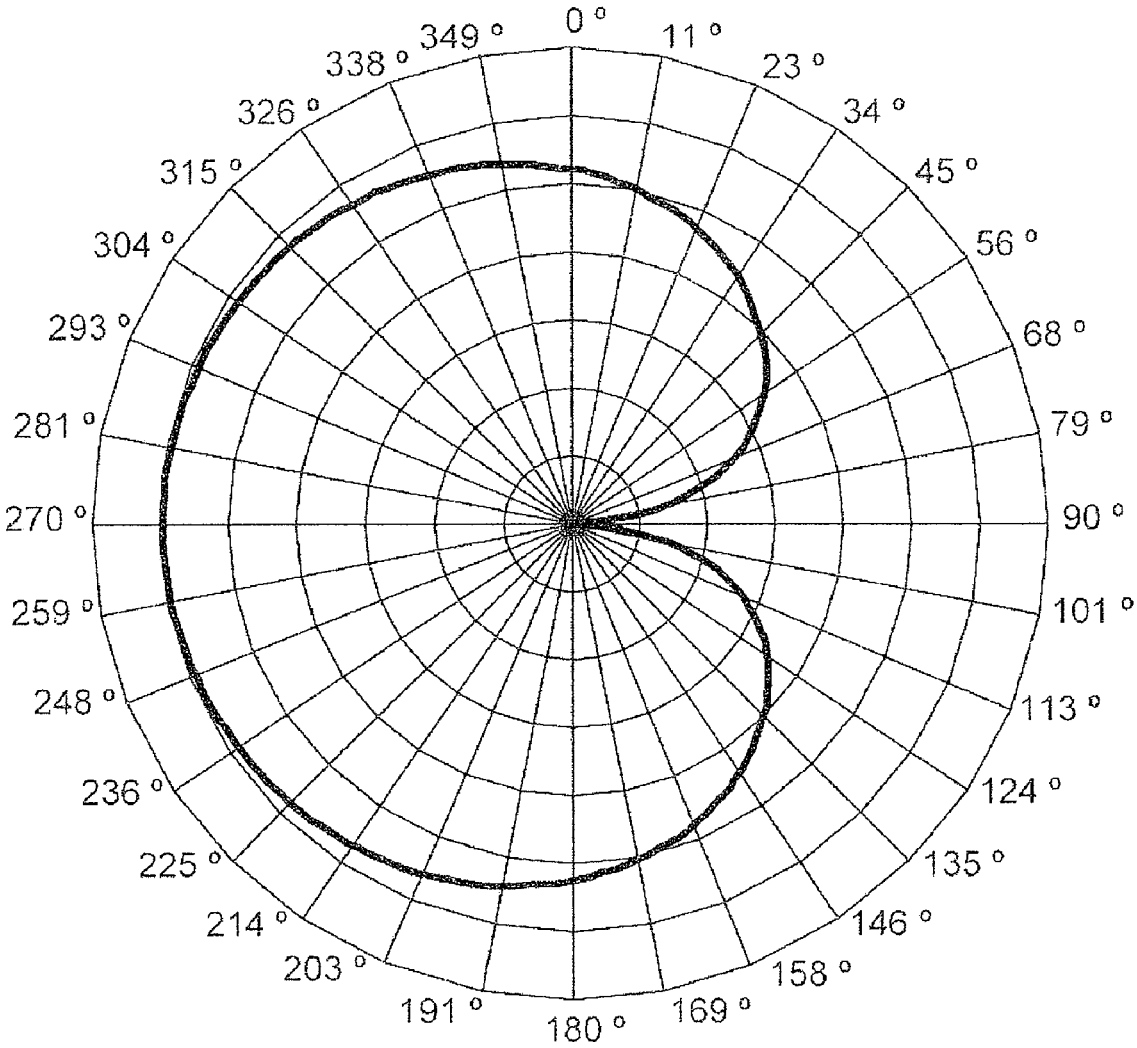
FIG. 9 shows the directional pattern of a signal calculated in accordance with the coupling of the embodiment of FIG. 4B in a 270-degree direction.

FIG. 8 shows the directional pattern of an oriented signal, calculated in accordance with the coupling of the embodiment according to FIG. 4B, in a 45-degree direction. It can be seen from the figure that the calculated signal has a cardioid pattern, which is a so-called orienting pattern. Such a microphone with a cardioid pattern effectively picks sounds in a given direction and on the sides of said direction, but leaves sounds coming from behind silent. FIG. 9 shows the directional pattern of a signal, calculated in accordance with the coupling of the embodiment according to FIG. 4B, in a 270-degree direction.

Figure 10:
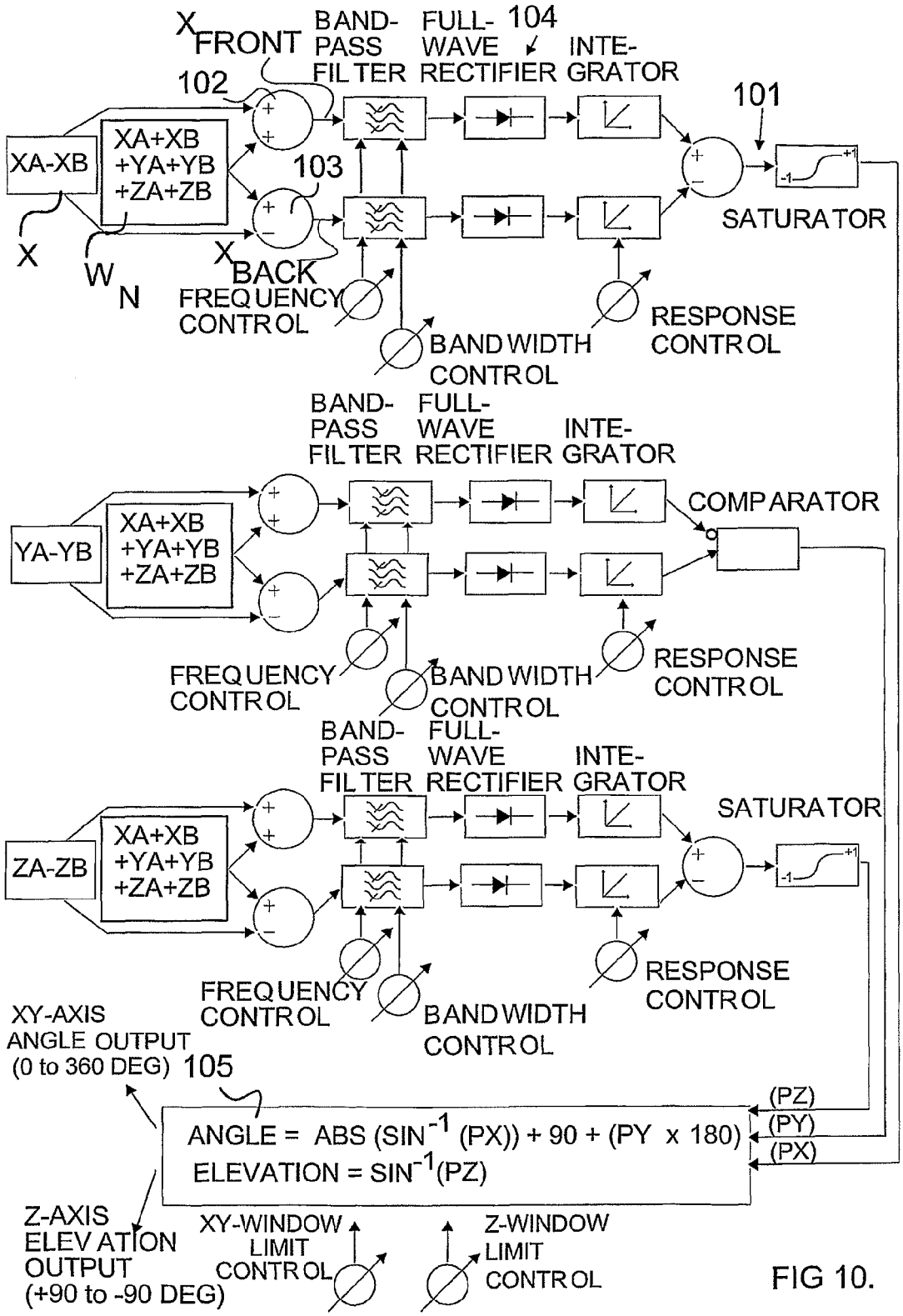
FIG. 10 shows a diagram of an embodiment for orienting a signal in direction XYZ.

FIG. 10 shows a diagram of an embodiment for orienting a signal in the XYZ direction. In accordance with the diagram, a band-pass filter can be used to select the frequencies of the sound to be received. The frequencies can be restricted with a frequency controller in such a manner than for instance sounds generated by by-passing cars can be eliminated. With a bandwidth controller, the device can be set to let through the width of the speech frequency range, for example.

The signal is then rectified with a full wave rectifier and integrated with an integrator. A response controller can be used to control the reaction of the microphone to the change. The response controller may adjust the time constant, composed of attack speed to new sounds, and the delay of giving up the current direction. The time constant can be used to adjust for instance the reaction of the device to sudden sounds, to a sudden coughing sound, for example.

The signals are then summed up with summing means 101. If a signal comes from the front, then the signal is positive. Contrarily, when a signal comes from behind, the signal is negative. The signal is calculated in the same way in the elevation direction. When a signal comes from above, the result of the addition is positive and negative if it comes from below. In addition, the device comprises a saturator, with which a value between −1 to +1 is obtained for the calculation.

Herein, block Y is similar, but instead of summing means and saturator, it includes a comparator for deciding if the signal is on the left or on the right. An abrupt decision is made herein to simplify angle calculation, this, however, not significantly weakening the accuracy of the result. In this case, the comparator transfers the signal to the other side at a predetermined point. This direction X and Y assembly enables direction determination between 0 and 360 degrees. It should be borne in mind that the structure of blocks X and Y may also be implemented inversely, whereby the comparator is situated in the block of signal X.

Direction calculation is implemented in a calculation unit 105. The angle is calculated by the formula: Angle=ABS $(SIN^{-1})PX+90+(PY*180)$. The elevation is calculated by the formula: Elevation $=(SIN^{-1})ZX$. In addition, the calculation unit 105 may comprise a direction XY window limit control unit and a Z window limit control unit. The XY window limit control unit may be used for instance to remove all signals coming from the back and the Z window limit control unit can be used to limit signals coming from the direction of a given elevation direction, more than 45 degrees, for example.

This assembly enables simple implementation, with sufficient accuracy, of a sound-following microphone that simulates the operation of the human ear. The device is usable for instance in video cameras, conference microphones or the like. In interview situations and conference situations, the device is capable of following the person who is speaking. This is realized also in the elevation direction, which is a problem when the speakers are of different heights or at different heights. The operation of the device is implementable also inversely for reproduction.

The device listens to all directions and determines the direction from which the sound is coming and indicates this direction. Using suitable settings, the device is usable also for surveillance. In this case, the device follows the sound source and may produce the sound source direction information also for use by another device. In this case, this direction information can be utilized for instance for controlling the direction of a surveillance camera, allowing one camera to be used for accurately monitoring even large spaces.

The device can be used for processing sound recorded with an acoustic transducer according to the invention. The device is preferably utilizable also for further processing of sound tracks, such as the sound track of a movie. With further processing, the voices of different people can be separated into different sound channels. Out of the signals generated by the device, the object of the desired direction can be separated and it can be emphasized by removing extra sounds associated with said direction. Accordingly, the sound produced by a given person or object can be separated to a separate sound channel, for example. In further processing, said device can also be used to make an override action for the recording for instance in a situation when the microphone starts to follow another sound source, a bypassing car, for example. Identification is made according to strength, but it may also be made by using some other selection criterion.

Figure 11:
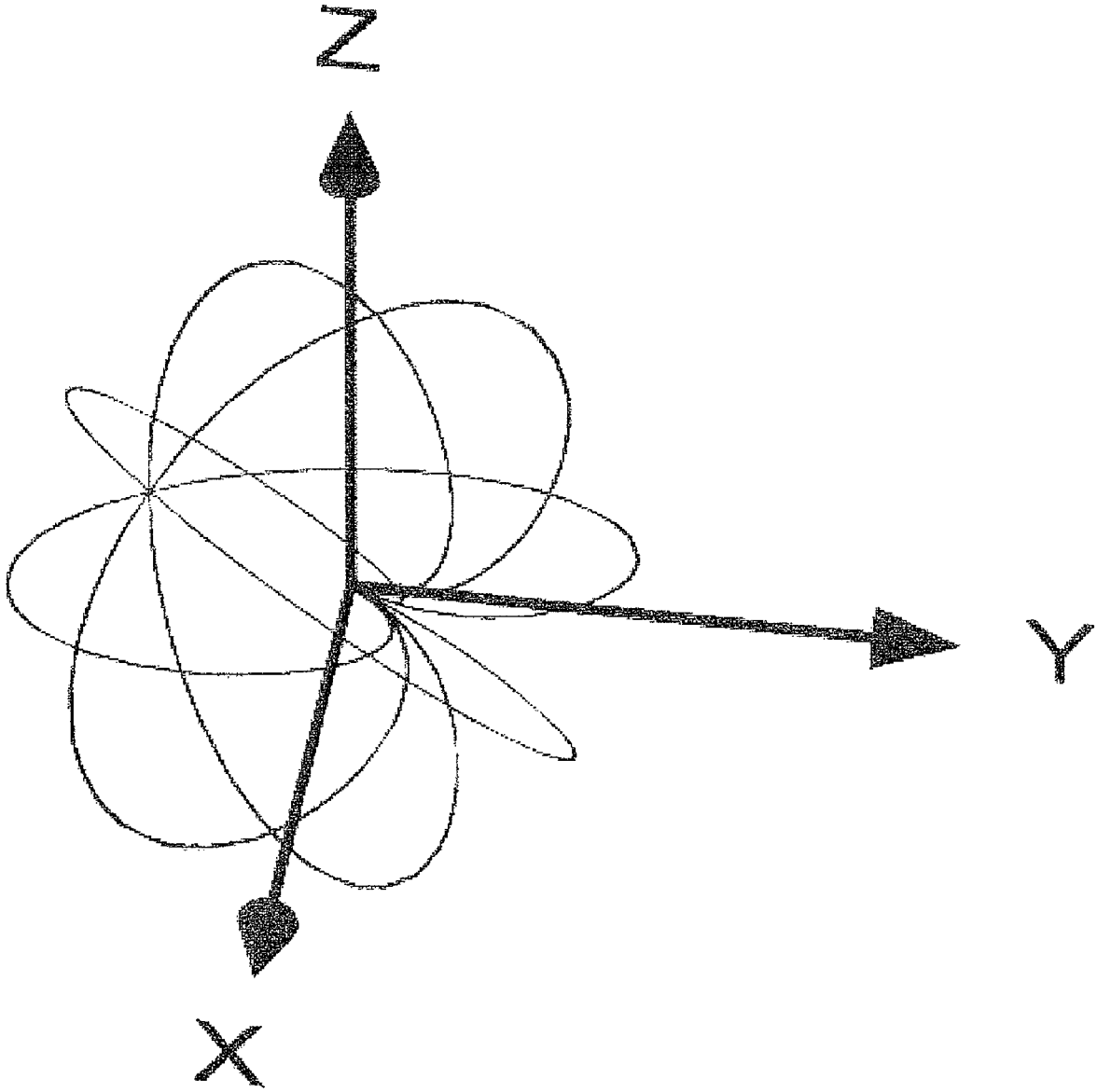
FIGS. 11 to 13 are examples of directional patterns oriented in accordance with the diagram of the embodiment according to FIG. 10 in direction XYZ.
Figure 12:
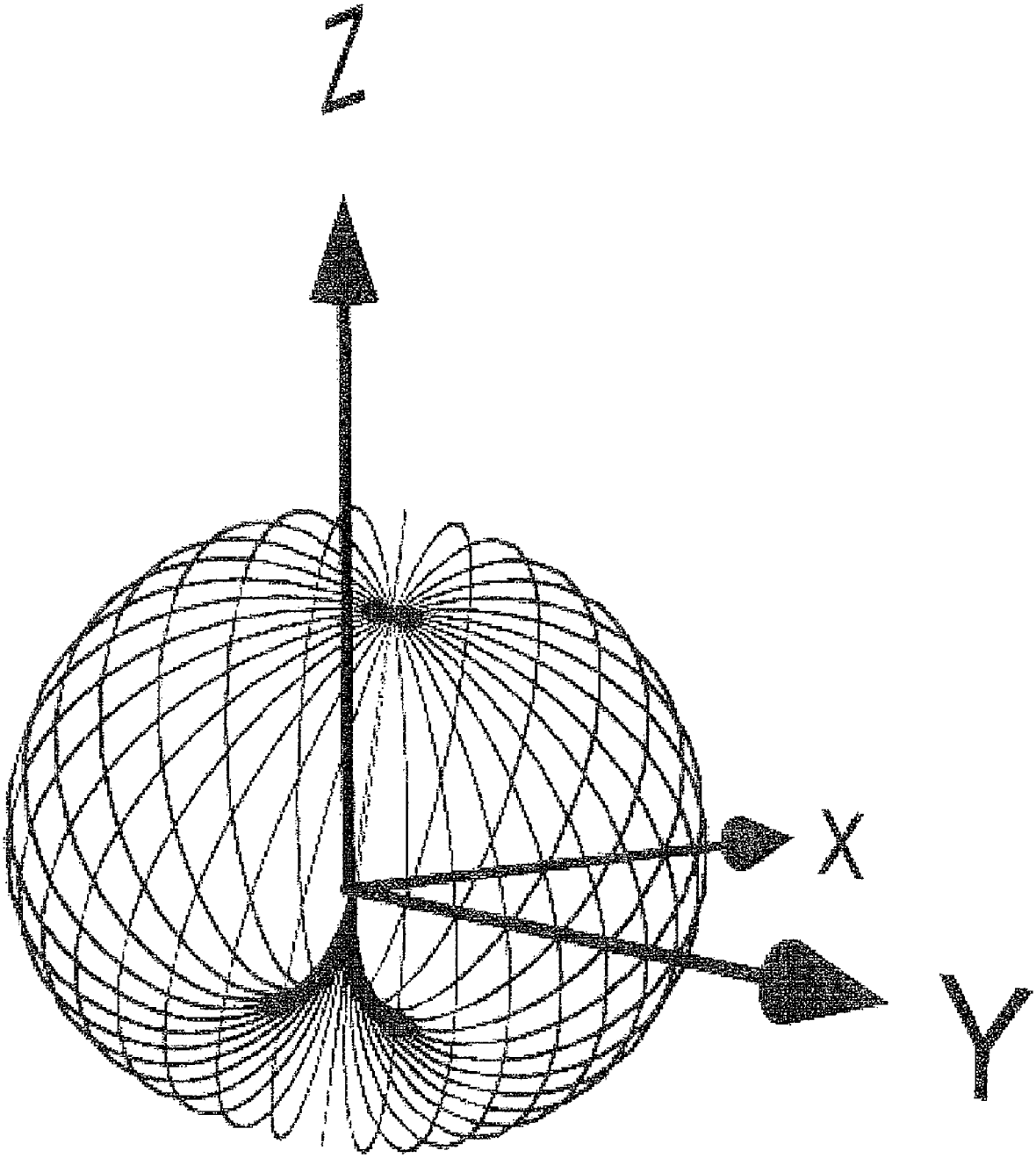
Figure 13:
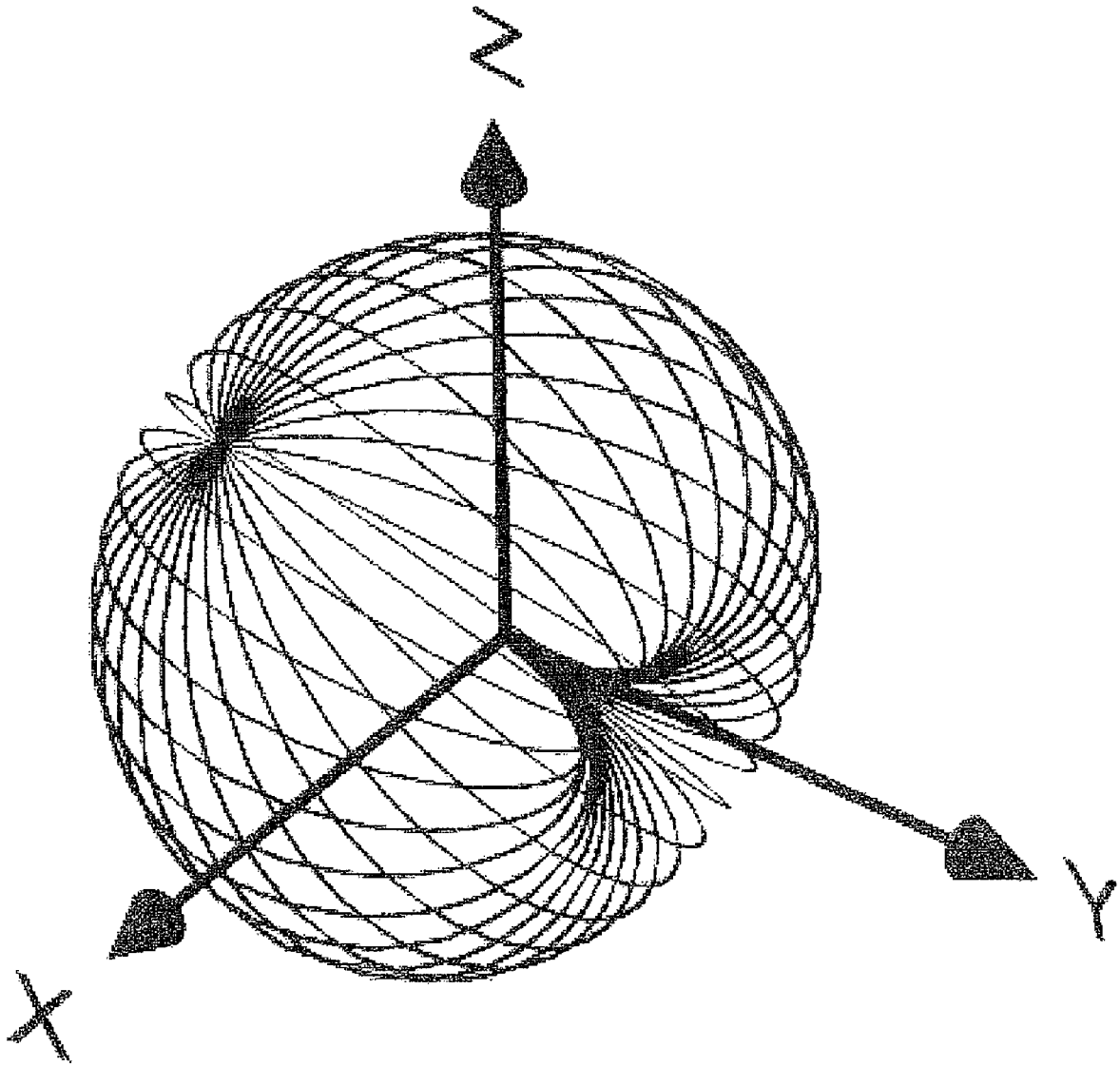

FIGS. 11 to 13 are examples of the directional patterns of the device according to the embodiment of FIG. 10 in direction XYZ.

Figure 14A:
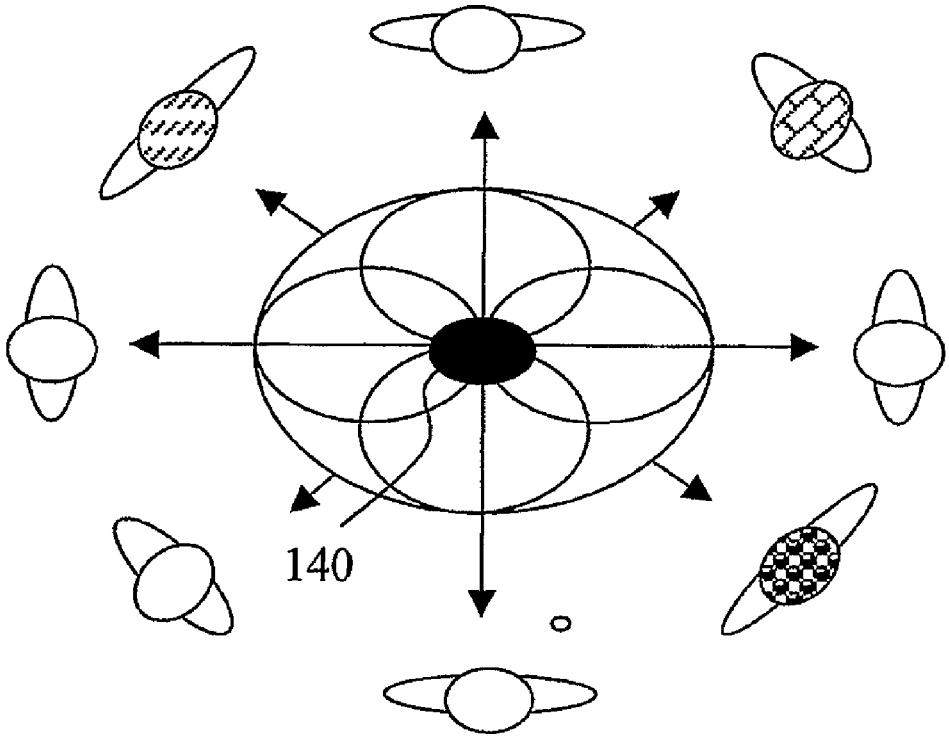
FIG. 14A shows an embodiment of a conference microphone for receiving sound, wherein three persons are speaking at the same time.
Figure 14B:
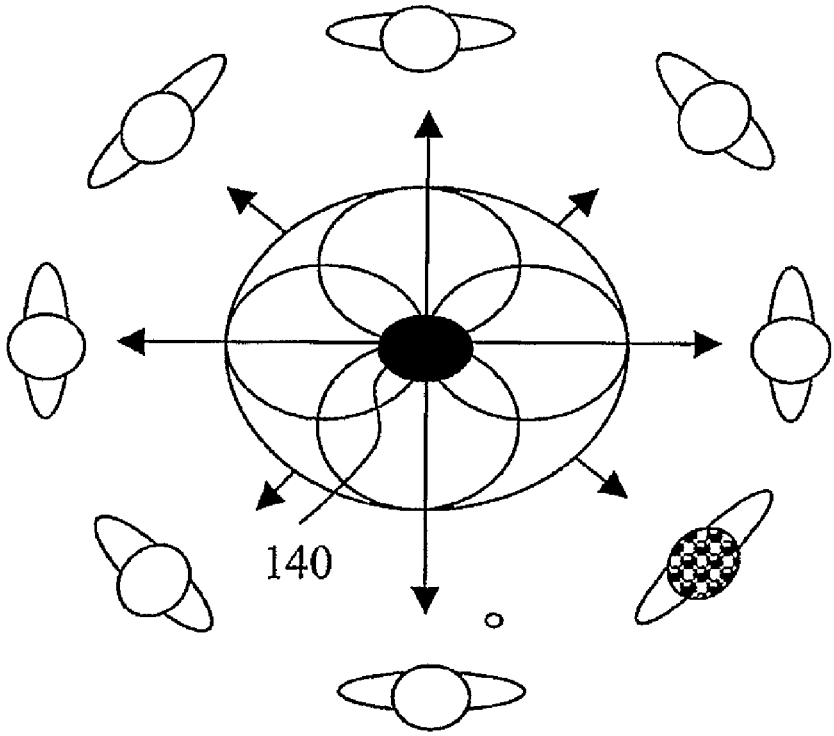
FIG. 14B shows a situation wherein the device according to an embodiment of the invention has separated and emphasized the sounds of one person only from the situation of FIG. 14A.

FIG. 14A shows a situation of sound reception for instance in a conference when three persons are speaking simultaneously. FIG. 14B shows a situation when a device 140 of the invention according the embodiment of FIG. 10 has separated and emphasized the sounds of one person only from the situation of FIG. 14A. Such a microphone is usable in teleconferences or videoconferences, for example. The device 140 comprises two or three microphones for receiving three signals. Three signals are separated with combination means into eight signals of different directions, for example, which are compared on the basis of a predetermined rule, volume, for example. Accordingly, the direction from which most signals or the strongest signal is coming is identified. Signal processing attenuates a weaker signal and emphasizes the selected signal. This being so, the signals may be separated from each other and the separation can be improved without all participants having to have a separate microphone.

Figure 15:
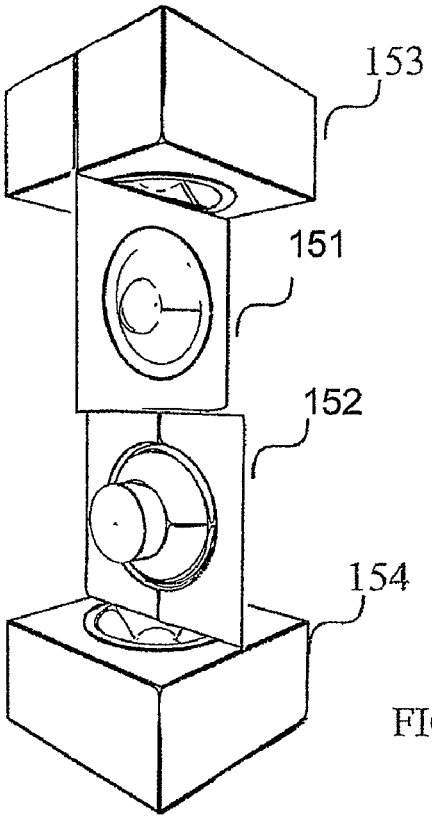
FIG. 15 shows an embodiment of a loudspeaker of an acoustic transducer according to the invention.

FIG. 15 shows a 2D embodiment of the loudspeaker of an acoustic transducer according to the invention. Loudspeaker elements 151, 152 of directions X and Y are superimposed perpendicularly relative to each other. Herein, elements W (omni) are divided into an upper element 153 and a lower element 154. Elements W may also be employed for reproducing low frequencies. Accordingly, signal processing may be performed inversely when the acoustic transducer is a loudspeaker. In this case, signals intended for five or eight loudspeakers can be implemented with two, three or four loudspeaker element with the loudspeaker according to the invention.

Figure 16:
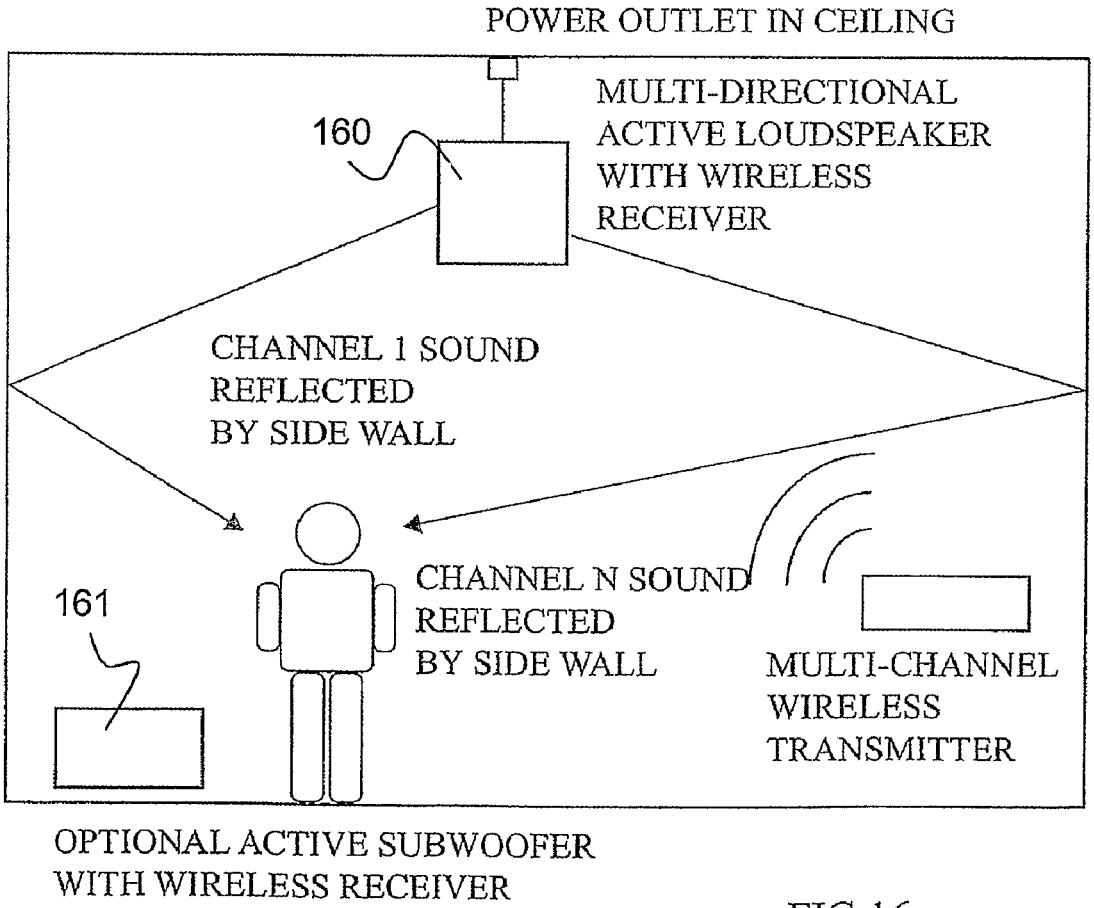
FIG. 16 shows an embodiment wherein the loudspeaker of FIG. 15 is placed in a room.

FIG. 16 shows an embodiment wherein the loudspeaker of FIG. 15 is placed in a room. The signals to be reproduced are transmitted with a multi-channel wireless transmitter to a loudspeaker assembly 160 and to a subwoofer 161 intended for reproducing low frequencies. Receivers arranged in connection with the loudspeaker receive the signals and reproduce them. The figure illustrates how signals are reflected via walls to the listener, thus creating an impression of spatial sound. A signal (X.1) having low frequencies is separated from the signal received in accordance with the embodiment by using a filtering means (LFE), which is arranged to separate the signal (X.1) having low frequencies. The low-frequency signal can be reproduced with a separate subwoofer 161 intended for reproducing low frequencies. The loudspeaker may further comprise a light source (not shown), whereby power intended for an illuminator may be utilized.

This is advantageous particularly when a signal is transferred wirelessly on three channels. In this case, the loudspeaker unit comprises a receiver unit for also receiving control of a remote control. This being so, the remote control (not shown) can be used to control the illumination and the strength of the audio signals. The same remote control can also be utilized for controlling light.

Figure 17:
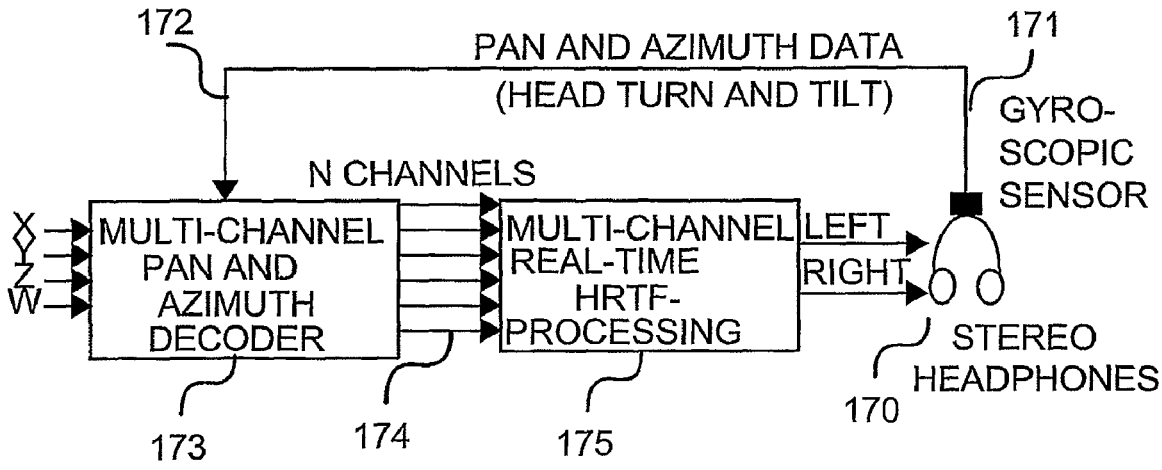
FIG. 17 shows an embodiment of the headphones of an acoustic transducer.

FIG. 17 shows an embodiment wherein the signals of the method according the invention are provided in headphones 170. Signals X, Y, Z and W, generated in accordance with the invention, are processed in a signal processing unit 173, a decoder, for example. The signal processing unit 173 is arranged to receive spatial information 172 received by a gyroscopic sensor 171 in the headphones. The spatial information 172 may comprise location and tilt information relative to a given reference point. The multi-channel pan and azimuth decoder 173 receives both sets of information and generates an n-channel 174, for instance a 26-channel, signal of different directions for an HRFT unit 175. The purpose of measurement-based HRFT processing is to generate sound corresponding to the behaviour of the ear for the headphones. Of these signals, representative of real spatial sound, the HTRF unit generates signals right and left to the right and left headphone of the listener, which signals provide spatial sound to the listener via the headphones 170. This arrangement provides the listener with not only excellent spatial sound but also a virtual sound scenery, which adapts itself in accordance with the movements of the listener's head. For example, the song of a solo singer heard from the television is always heard from the direction wherein the image source is situated, even if the listener were positioned at the edge of a room or if the head of the listener were turned to another direction. Such a sound scenery is particularly advantageous for simulation purposes, for instance in computer games, when a wide screen, several screens or an eye screen is used.

Figure 18A:
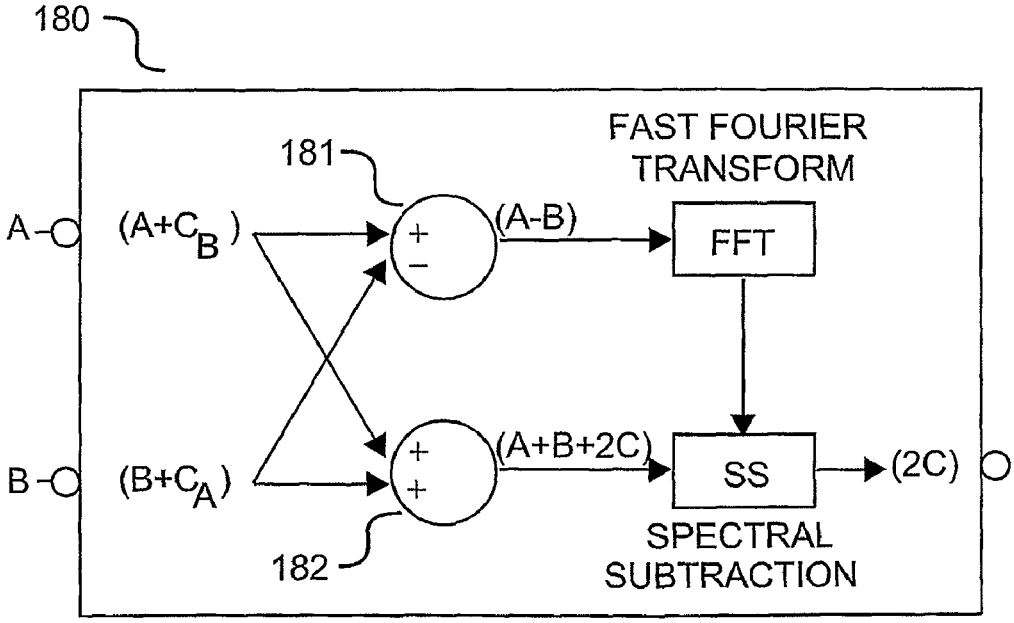
FIG. 18A shows an embodiment of the invention for orienting signal reception or reproduction.
Figure 18B:
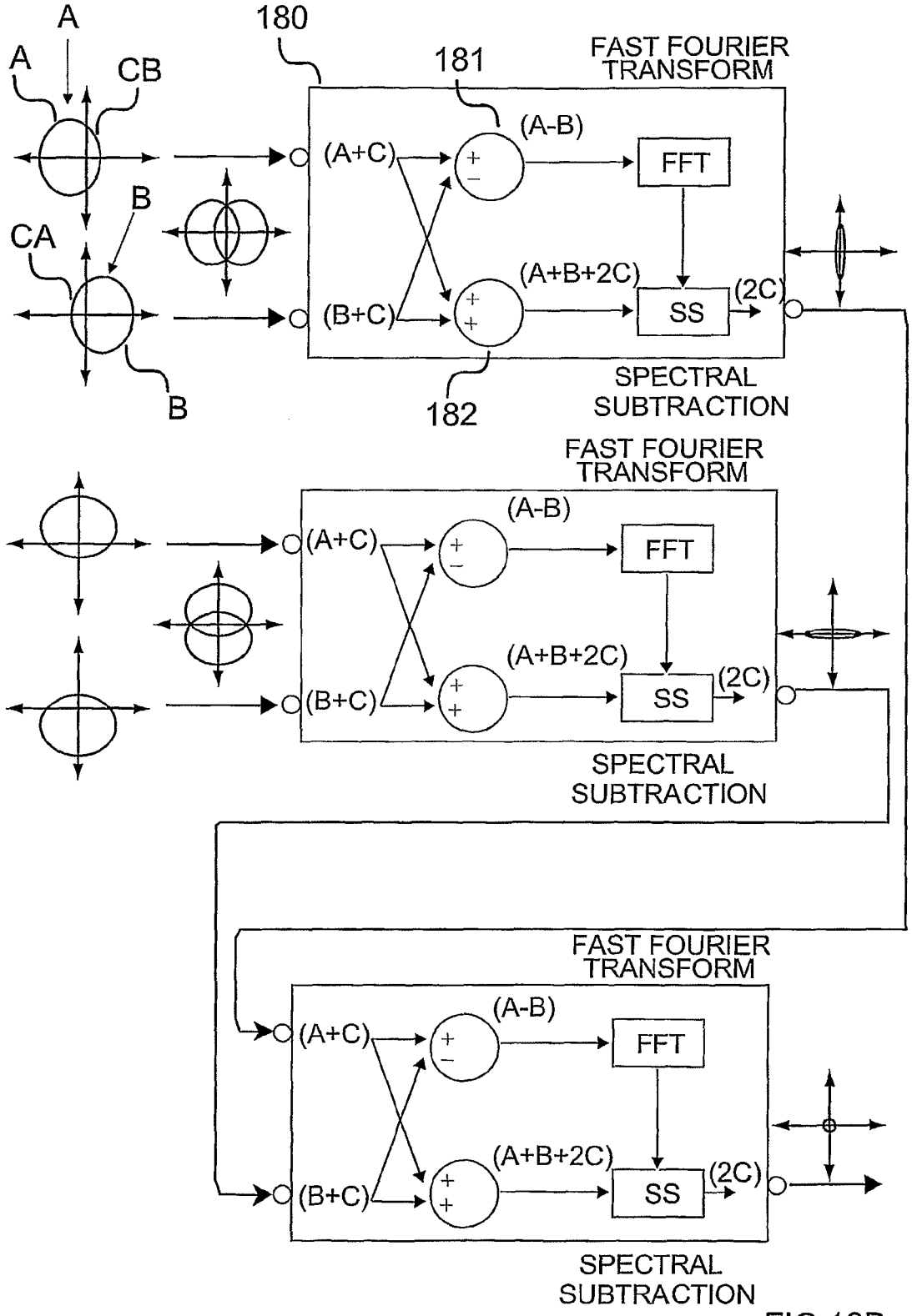
FIG. 18B shows an embodiment wherein the steps of FIG. 18A are implemented for two signal pairs for further orienting reception and reproduction.

FIG. 18A shows an embodiment of the invention for orienting signal reception or reproduction. Here, signals A and B are received with an acoustic transducer according to the invention, from where the signals are fed to an orientation supplementary device. Two channels A and B are fed to the orientation device 180, of which one contains A and CB, which is common with B. The second channel contains B and $C_A$, which is common with A.

The signals are combined in a first summing means 181 by subtracting $(B+C_A)$ from $(A+C_B)$. The common signal portion C is thus cancelled out and signal (A−B) is obtained as a result of the combination.

Frequency transformation is then performed in an FFT unit (Fast Fourier Transform), wherein the transform coefficients represent the signal in the frequency dimension. In signal processing, such a frequency transformation can be implemented for instance by using the Fast Fourier Transformation (FFT) algorithm.

At the same time, signals $(A+C_B)$ and $(B+C_A)$ are combined in a second summing means 182. Signal (A+B+2C) is obtained as a result. Signal (A+B+2C) is then input into a digital SS (Spectral Subtraction) filter having equally narrow frequency bands as those in the FFT unit. These frequency bands are attenuated according to information obtained from the FFT unit, whereby common C parts $(C_A, C_B)$ are obtained from A and B. This C part can now be utilized in directing the orientation. A narrowed directional pattern is obtained as a result, whereby two signals provided by an acoustic transducer according to the invention can be used with this solution to provide an oriented point-like directioning, even if signals were received from an acoustic transducer having a wide directional pattern. FIG. 18A shows an embodiment, wherein the method according to FIG. 18A is implemented for signals received by two acoustic transducers. The method is implemented in accordance with FIG. 18A for the signals of two directions, directions XY, for example. The C parts obtained as a result are once more subjected to the method steps of FIG. 18A, whereby the result obtained is a still more oriented C part.

It is obvious to a person skilled in the art that as technology advances, the basic idea of the invention can be implemented in a variety of ways. Consequently, the invention and its embodiments are not restricted to the above examples, but can vary within the scope of the claims.

The invention claimed is:

1. An assembly of acoustic transducers for receiving or reproducing sound, the assembly comprising:

a first dual-diaphragm acoustic transducer capable of providing a directional pattern of the shape of a figure of eight in the direction of an X axis of a XYZ coordinate system, and a second dual-diaphragm acoustic transducer placed perpendicularly relative to a first capsule and capable of providing a directional pattern of the shape of a figure of eight in the direction of a Y axis of a XYZ coordinate system, wherein the assembly further comprises a third dual-diaphragm acoustic transducer placed perpendicularly relative to the first and second acoustic transducer, enabling the reception or reproduction of sound both in a XY plane and in a XYZ plane by using these acoustic transducers placed in accordance with an axis of the axes of the XYZ coordinate system.

2. An assembly as claimed in claim 1, wherein the dual-diaphragm acoustic transducer is a loudspeaker.

3. An assembly as claimed in claim 1, wherein the third dual-diaphragm acoustic transducer is capable of providing a directional pattern in the shape of a figure of eight.

4. An assembly as claimed in claim 3, wherein the dual-diaphragm acoustic transducer (10, 20, 30) is a hydrophone.

5. An assembly as claimed in claim 3, wherein the dual-diaphragm acoustic transducers are dual-diaphragm microphone capsules.

6. An assembly as claimed in claim 3, wherein the dual-diaphragm acoustic transducers are superimposed.

7. An assembly as claimed in claim 3, wherein the dual-diaphragm acoustic transducers are placed adjacently such that the surface of the outer periphery of each transducer is in the immediate vicinity of the outer surface of the two other capsules.

8. An assembly as claimed in claim 7, wherein the first and second dual-diaphragm acoustic transducer include a filtering part that is placed at least partly above said dual-diaphragm acoustic transducer.

9. An assembly as claimed in claim 8, wherein the filtering part has a curved shape such that its outer surface is arranged to reflect signals into the middle dual-diaphragm acoustic transducer and its inner surface is arranged to attenuate signals hitting it.

10. An assembly as claimed in claim 9, wherein signal-permeable openings are arranged in a wall of the filtering part.

* * * * *